US009295956B2

(12) United States Patent
Hall

(10) Patent No.: US 9,295,956 B2
(45) Date of Patent: Mar. 29, 2016

(54) REFRIGERATED AGITATOR ASSEMBLY FOR MIXERS

(75) Inventor: Michael W. Hall, Sidney, OH (US)

(73) Assignee: Shaffer Manufacturing Corporation, Urbana, OH (US)

( * ) Notice: Subject to any disclaimer, the term of this patent is extended or adjusted under 35 U.S.C. 154(b) by 1022 days.

(21) Appl. No.: 12/893,675

(22) Filed: Sep. 29, 2010

(65) Prior Publication Data

US 2011/0075508 A1 Mar. 31, 2011

Related U.S. Application Data

(60) Provisional application No. 61/246,793, filed on Sep. 29, 2009.

(51) Int. Cl.

| | |
|---|---|
| ***B01F 7/04*** | (2006.01) |
| ***B01F 15/06*** | (2006.01) |
| ***B01F 7/00*** | (2006.01) |

(52) U.S. Cl.

CPC ..... *B01F 15/068* (2013.01); *B01F 7/0025* (2013.01); *B01F 7/00116* (2013.01); *B01F 7/00175* (2013.01); *B01F 2015/061* (2013.01)

(58) Field of Classification Search

CPC ..... B01F 7/00116; B01F 15/068

USPC ..... 366/147; 165/92; 62/342

See application file for complete search history.

(56) References Cited

U.S. PATENT DOCUMENTS

| | | | | |
|---|---|---|---|---|
| 452,973 | A * | 5/1891 | McCoy | 165/92 |
| 881,128 | A * | 3/1908 | Jensen | 165/92 |
| 1,255,842 | A * | 2/1918 | Adt | 165/92 |
| 2,118,421 | A * | 5/1938 | Steinmann | 165/92 |
| 3,788,392 | A * | 1/1974 | Abbott et al. | 165/92 |
| 6,047,558 | A * | 4/2000 | Hall | 62/343 |
| 8,021,036 | B1 * | 9/2011 | Fay et al. | 366/147 |

* cited by examiner

*Primary Examiner* — David Sorkin

(74) *Attorney, Agent, or Firm* — McNees Walllace & Nurick LLC

(57) ABSTRACT

An agitator assembly for use with mixers is provided. This agitator assembly includes an agitator shaft adapted to receive a flow of liquid coolant therethrough; a first hub assembly mounted on the agitator shaft; a second hub assembly mounted on the agitator shaft; at least one agitator bar connecting the first hub extension to the second hub extension, wherein the agitator bar further includes a conduit for delivering liquid coolant from the first hub extension to the second hub extension; and at least one agitator bar connecting the second hub extension to the first hub extension, wherein the agitator bar further includes a conduit for returning liquid coolant from the second hub extension to the first hub extension.

20 Claims, 7 Drawing Sheets

REFRIGERATED AGITATOR ASSEMBLY FOR MIXERS

CROSS-REFERENCE TO RELATED APPLICATIONS

This patent application claims the benefit of U.S. Provisional Patent Application Ser. No. 61/246,793 filed on Sep. 29, 2009 and entitled "Refrigerated Agitator Assembly for Mixers," the disclosure of which is hereby incorporated by reference herein in its entirety and made part of the present U.S. utility patent application for all purposes.

BACKGROUND OF THE INVENTION

The described invention relates in general to a system and apparatus for mixing viscous substances such as dough, and more specifically to a refrigerated agitator assembly which may be incorporated into industrial horizontal dough mixers for controlling the temperature of the substance being mixed during the mixing process.

Friction and viscous shear encountered during mixing typically causes a temperature rise in a substance being mixed. This temperature rise becomes more severe as mixing speed increases and can adversely affect a mixing process by making the substance sticky and difficult to process. Accordingly, mixers, particularly dough mixers, are most effective when equipped with some type of temperature control means, whereby the temperature of the substance to be mixed may be stabilized at a predetermined level or maintained below a predetermined threshold. For example, bread dough should be mixed at a temperature of about 78-80° F. A known means for controlling the temperature of a substance being mixed is through the use of a refrigeration jacket attached to the mixing bowl component of a mixer. Bowl refrigeration jackets, also referred to as "cooling jackets" usually include multiple coolant channels that are arranged perpendicular to the ends of a mixing bowl, and which are arrayed around the profile of the mixing bowl.

Large commercial scale dough mixers may be manufactured both with and without mixing bowl cooling jackets based primarily on the type and quantity of dough to be mixed. The performance, i.e., cooling capacity, of a refrigeration system used with a commercial scale mixer is the ability of the mixing bowl cooling jacket to remove heat from within the mixing bowl during a batch cycle. As previously indicated, major sources for heat generated during the mixing process are dough ingredient temperatures, ambient temperatures around the mixer, and heat generated from friction and shearing forces within the mixing bowl as the dough is processed. In some circumstances, these variables make it difficult or impossible for a mixing bowl cooling jacket to provide adequate cooling.

U.S. Pat. No. 6,047,558, which is incorporated herein by reference in its entirety for all purposes, teaches the use of a refrigerated agitator assembly as a means for increasing or enhancing the cooling capacity of a refrigeration system incorporated into a mixing apparatus. While effective for its intended purpose, this system is known to experience multiple sources of coolant leaks within the mixer product zone and to possess inefficient internal flow characteristics. Thus, there is an ongoing need in the art of dough mixing for a refrigerated agitator assembly having enhanced coolant sealing, simplified manufacturing, and more efficient cooling characteristics.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, an agitator assembly for use with mixers is provided. This agitator assembly includes an agitator shaft adapted to receive a flow of liquid coolant therethrough; a first hub assembly mounted on the agitator shaft; a second hub assembly mounted on the agitator shaft; at least one agitator bar connecting the first hub extension to the second hub extension, wherein the agitator bar further includes a conduit for delivering liquid coolant from the first hub extension to the second hub extension; and at least one agitator bar connecting the second hub extension to the first hub extension, wherein the agitator bar further includes a conduit for returning liquid coolant from the second hub extension to the first hub extension. The first hub assembly further includes a hub adapted to receive a flow of liquid coolant therethrough; and a first hub extension adapted to receive a flow of liquid coolant therethrough, wherein the hub and the first hub extension are in fluid communication with one another and with the agitator shaft. The second hub assembly further includes a hub; and a second hub extension adapted to receive a flow of liquid coolant therethrough.

In accordance with another aspect of the present invention, an agitator assembly for use with industrial mixers is provided. This agitator assembly includes an agitator shaft; a first hub assembly mounted on one end of the agitator shaft; a second hub assembly mounted on the opposite end of the agitator shaft; and at least one dual agitator bar assembly. The agitator shaft further includes both a fluid supply passage and a fluid return passage for liquid coolant. The first hub assembly further includes a hub having a set of fluid supply and return passages formed therein, wherein the fluid supply and return passages in the hub are in fluid communication with the fluid supply and return passages in the agitator shaft; and a first hub extension attached to the hub, wherein the first hub extension includes fluid supply and return passages that are in fluid communication with the fluid supply and return passages formed in the hub. The second hub assembly further includes a hub; and a second hub extension attached to the hub, wherein the second hub extension further includes a fluid inlet and a fluid outlet and a transfer duct connecting the fluid inlet to the fluid outlet. The dual agitator bar assembly further includes a first agitator bar, wherein the first agitator bar further includes a conduit for transferring coolant between the fluid supply passage of the first hub extension and fluid inlet of the second hub extension; and a second agitator bar, wherein the second agitator bar further includes a conduit for transferring coolant between the fluid outlet of the second hub extension and the fluid return passage of the first hub extension.

In yet another aspect of this invention, an agitator assembly for use with industrial mixers used for bread dough and the like is provided. This agitator assembly includes an agitator shaft; a first hub assembly mounted on one end of the agitator shaft; a second hub assembly mounted on the opposite end of the agitator shaft; a dual agitator bar assembly; a third agitator bar; and a fourth agitator bar. The agitator further includes both a fluid supply passage and a fluid return passage for liquid coolant. The first hub assembly further includes a hub having a first set of fluid supply and return passages formed therein and a second set of fluid supply and return passages formed therein, wherein both sets of fluid supply and return passages in the hub are in fluid communication with the fluid supply and return passages in the agitator shaft; a first hub extension attached to the hub, wherein the first hub extension includes fluid supply and return passages that are in fluid communication with the first set of fluid supply and return passages formed in the hub; and a second hub extension attached to the hub, wherein the second hub extension includes fluid supply and return passages that are in fluid communication with the second set of fluid supply and return passages formed in the hub. The second hub assembly further include a hub; a third hub extension attached to the hub, wherein the third hub extension further includes a fluid inlet and a fluid outlet and a first transfer duct connecting the fluid inlet to the fluid outlet; and a fourth hub extension attached to the hub, wherein the fourth hub extension further includes a fluid inlet and a fluid outlet and a second transfer duct connecting the fluid inlet to the fluid outlet. The dual agitator bar assembly further includes a first agitator bar, wherein the first agitator bar includes a conduit for transferring coolant between the fluid supply passage of the first hub extension and fluid inlet of the third hub extension; and a second agitator bar, wherein the second agitator bar includes a conduit for transferring coolant between the fluid outlet of the third hub extension and the fluid return passage of the first hub extension. The third agitator bar further includes a conduit for transferring coolant between the fluid supply passage of the second hub extension and the fluid inlet of the fourth hub extension. The fourth agitator bar further includes a conduit for transferring coolant between the fluid outlet of the fourth hub extension and fluid return passage of the second hub extension.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
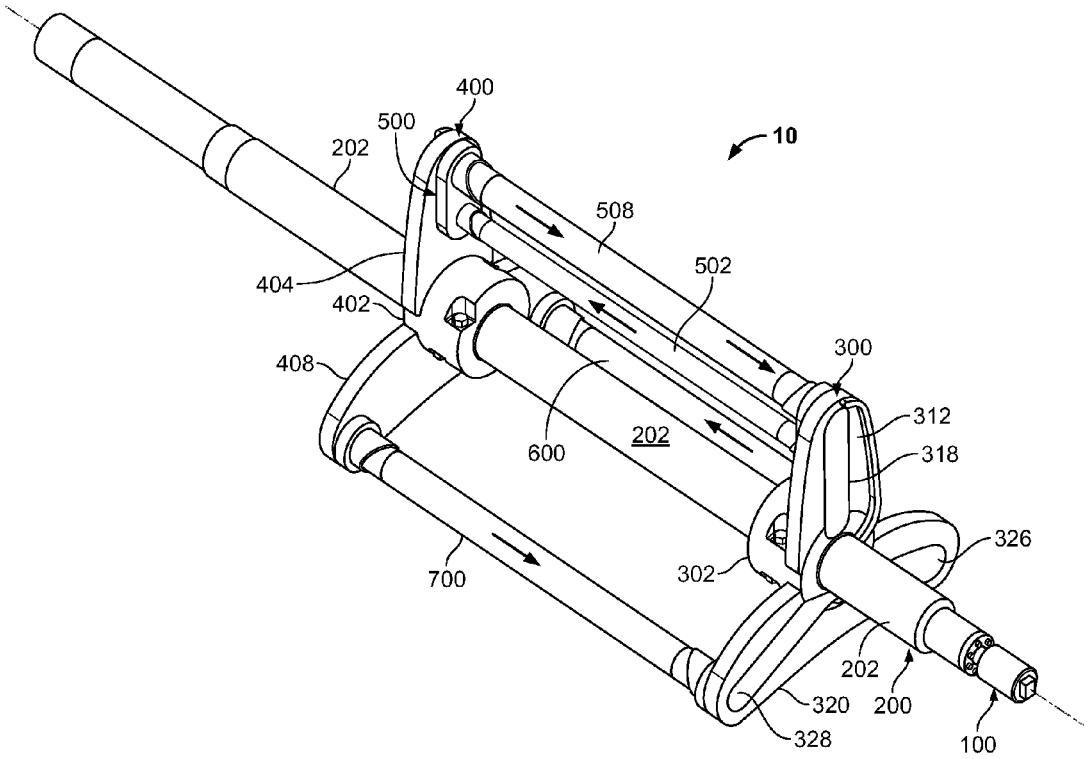
FIG. 1 is a front perspective view of an exemplary embodiment of an agitator assembly for mixers, in accordance with the present invention.

Exemplary embodiments of the present invention are now described with reference to the Figures. Reference numerals are used throughout the detailed description to refer to the various elements and structures and arrows are used to indicate the direction of coolant flow through the system. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

Figure 2:
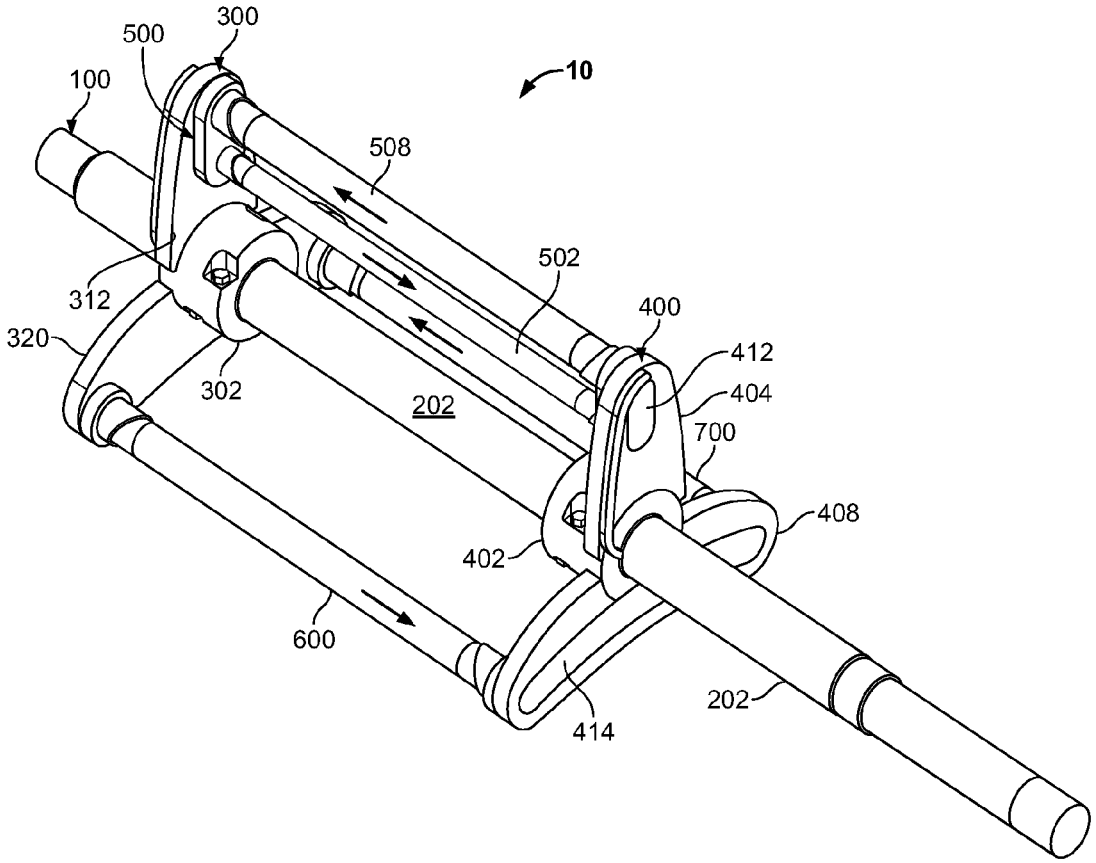
FIG. 2 is a rear perspective view of the agitator assembly of FIG. 1.
Figure 3:
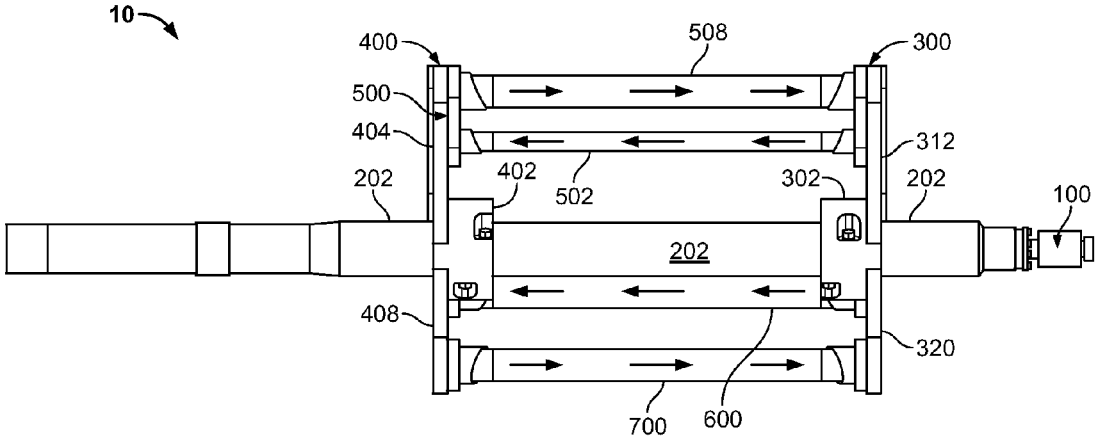
FIG. 3 is a side view of the agitator assembly of FIG. 1.

The present invention relates to a refrigerated agitator assembly for use with mixers. As previously indicated, a first general embodiment of this invention provides an agitator assembly for use with mixers that include a cooling or refrigeration circuit; a second general embodiment of this invention provides an agitator assembly for use with industrial mixers; and a third general embodiment of this invention provides an agitator assembly for use with industrial or commercial mixers used for bread dough and the like. With reference now to the Figures, one or more specific embodiments of this invention shall be described in greater detail. FIGS. 1-7 provide various views illustrative views of an exemplary embodiment of refrigerated agitator assembly 10, in accordance with the present invention. As shown in FIGS. 1-3, agitator assembly 10 is typically stainless steel or other suitable metal and includes rotary union assembly 100, agitator shaft assembly 200, right hub assembly 300, left hub assembly 400, double agitator bar assembly 500, supply (i.e., forward flow) agitator bar 600, and return (i.e., reverse flow) agitator bar 700.

Figure 4:
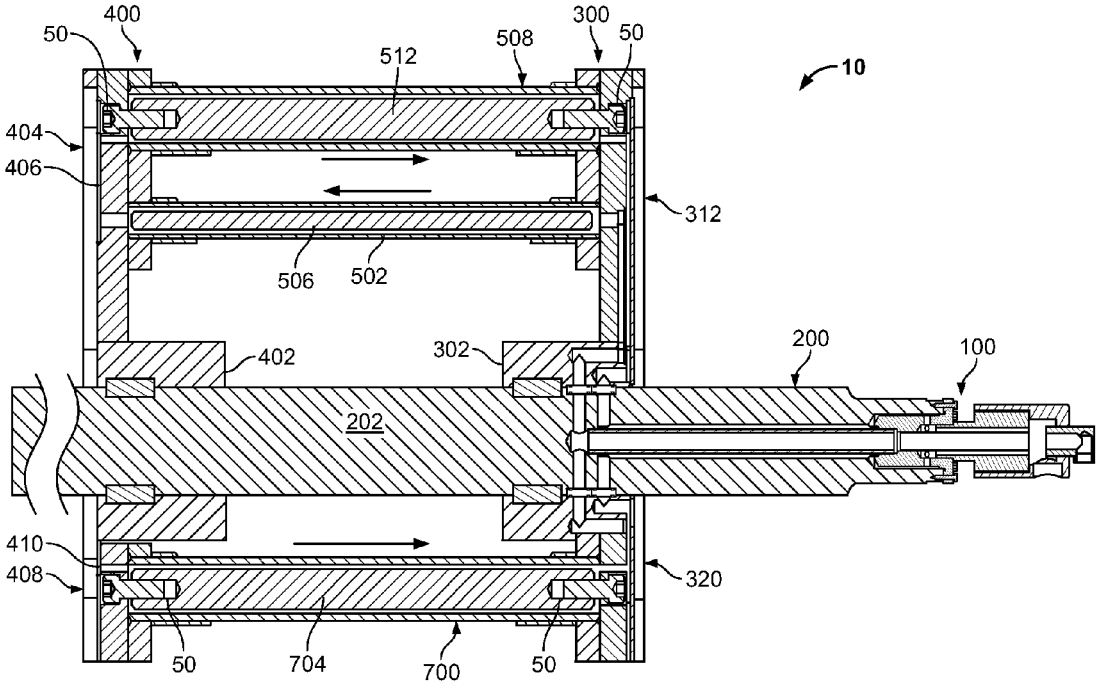
FIG. 4 is a cross-sectional view of the agitator assembly of FIG. 1.
Figure 5:
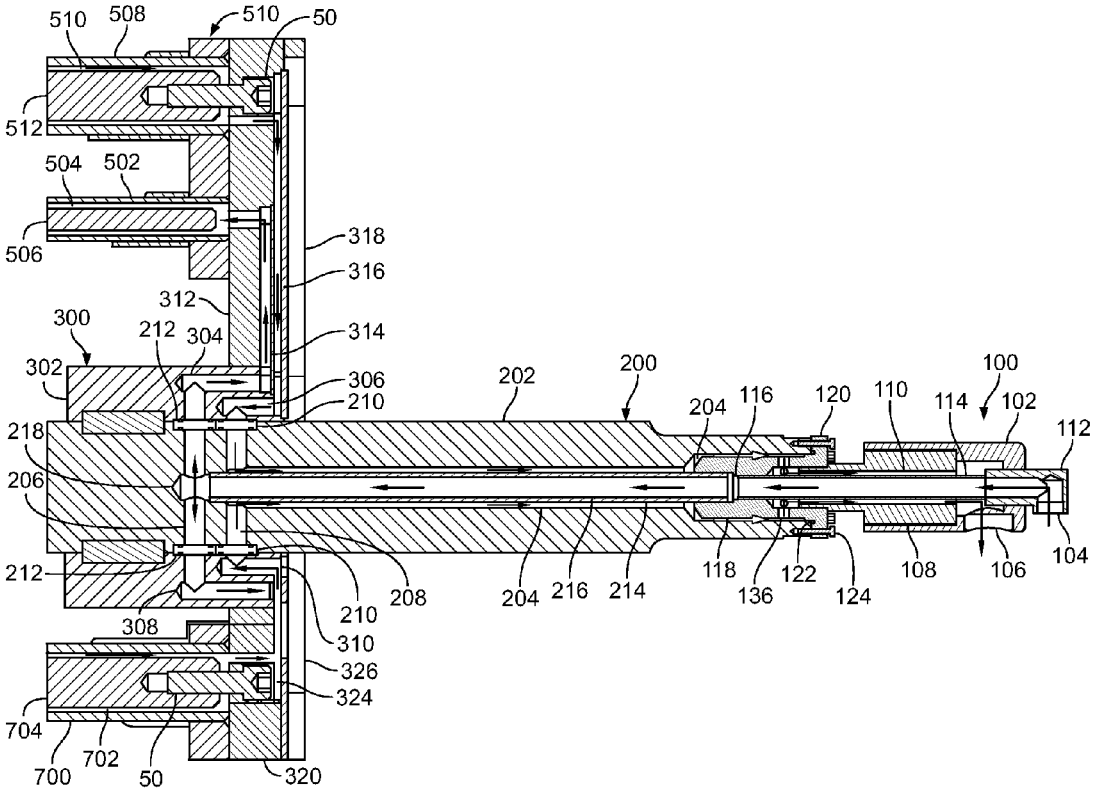
FIG. 5 is a cross-sectional view of the right-hand side of the agitator assembly of FIG. 1.

As best shown in FIGS. 4-5, rotary union assembly 100 includes housing 102 that further includes fluid inlet 104 for receiving a supply of liquid coolant or refrigerant (note: these terms are used interchangeably herein) and fluid outlet 106 for removing the liquid coolant or refrigerant from the cooling circuit. A liquid coolant or refrigerant that is compatible with this invention is glycol, although other acceptable coolants or refrigerants may be used. Rotary union body 108 includes conduit 110 running lengthwise therethrough, and stationary coolant feed tube 114, which is in fluid communication with rotary union fluid inlet 112, is positioned within conduit 110 such that a portion of the diameter of conduit 110 remains open to accept the flow of coolant leaving the circuit. Bushing 116 is used to seal the connection between stationary coolant feed tube 114 and rotating feed tube 214. One end of rotary union body 108 is inserted into rotary union adapter 118 and adapter end cap 120 is secured to agitator shaft 202 using connectors 124. 0-ring 122 is used to seal the connection between rotary union adapter 118 and agitator shaft 202. The external diameter of rotary union body 108 is less than the diameter of conduit 204, which is formed in agitator shaft 202 for allowing coolant leaving the circuit to pass through conduit 204. Rotary union body 108 includes a plurality of ducts 136 formed therein for allowing coolant leaving the circuit to pass through rotary union body 108 and into conduit 100.

As best shown in FIGS. 4-5, rotatable agitator shaft assembly 200 includes dual flow agitator shaft 202, which further includes variable diameter conduit 204, which is formed lengthwise through the body of agitator shaft 202. Coolant supply duct 206 is formed transversely (i.e., perpendicular to conduit 204) in agitator shaft 202 and functions as a passage for coolant to leave agitator shaft 202 at two locations. Coolant return duct 208 is formed transversely (i.e., perpendicular to conduit 204) in agitator shaft 202 and functions as a passage for coolant to enter agitator shaft 202 and conduit 204 at two locations. In this embodiment, four seal inserts 210 cooperate with a series of o-rings 212 to effectively seal the connections between ducts 206 and 208 and the supply and return ducts formed in hub 302. Rotating coolant feed tube 214 is positioned within conduit 204 and the external diameter of this tube is less than the diameter of conduit 204 for allowing coolant leaving the circuit to pass through conduit 204. Conduit 216 is formed though the length of rotating coolant feed tube 214 for supplying coolant to supply duct 206 through tip or terminus 218.

Figure 6:
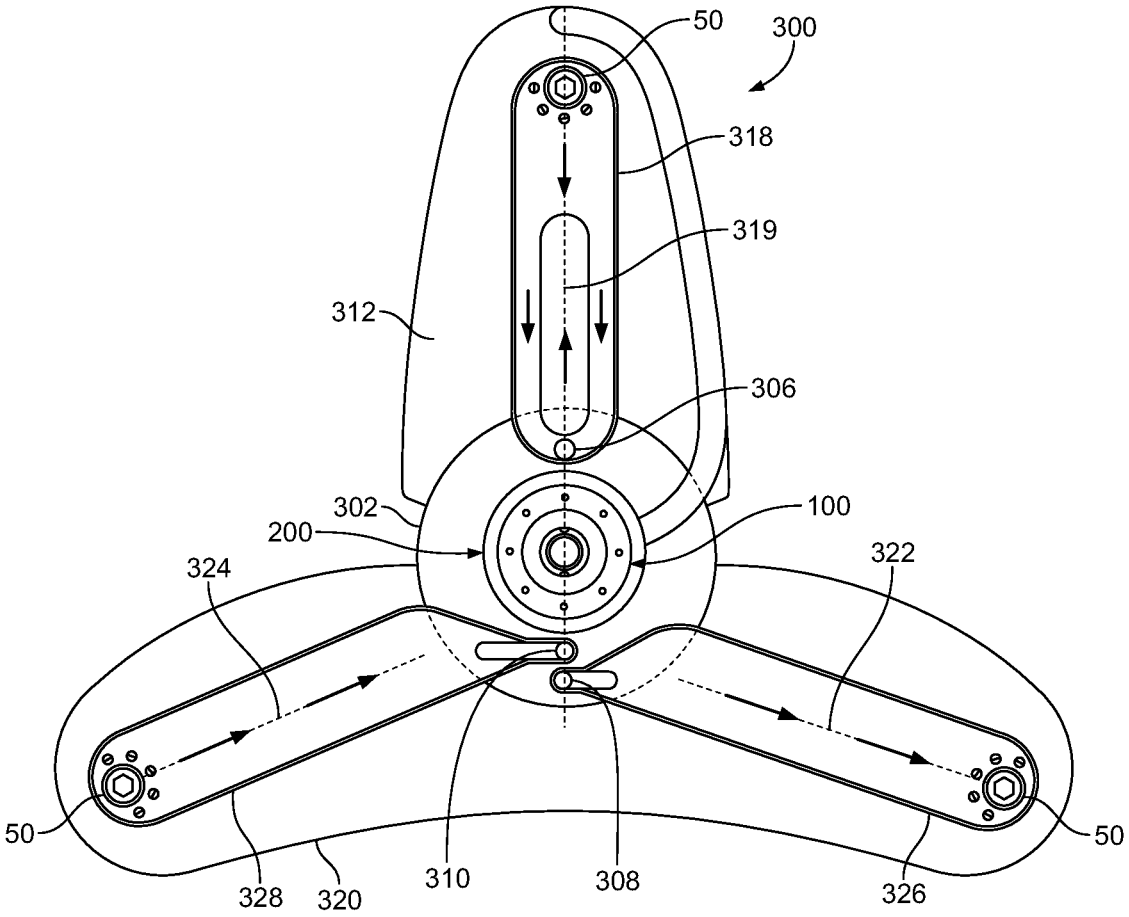
FIG. 6 is an end view of the right-hand side of agitator assembly of FIG. 1.

As best shown in FIG. 5, right hub assembly 300 (which may also be referred to as a "spider" or a "spider hub") includes right hub 302, which is mounted on agitator shaft 202. Right hub 302 includes supply duct 304 for supplying coolant to first hub extension 312 and return duct 306 for receiving coolant from first hub extension 312. Right hub 302 also includes supply duct 308 for supplying coolant to second hub extension 320 and return duct 310 for receiving coolant from second hub extension 320. As best shown in FIGS. 5-6, first hub extension 312 is attached to right hub 302 and includes supply duct 314 for supplying coolant to double agitator bar assembly 500 and return duct 316 for receiving coolant from double agitator bar assembly 500. Ducts 314 and 316 are typically machined into the metal of first hub extension 312 and then enclosed within first hub extension 312 by welding cover plates 318 and 319 (see FIG. 6) over these ducts. Second hub extension 320 is also attached to right hub 302 and includes supply duct 322 for supplying coolant to supply (i.e., forward flow) agitator bar 600 and return duct 324 for receiving coolant from return (i.e., reverse flow) agitator bar 700. Ducts 322 and 324 are typically machined into the metal of second hub extension 320 and then enclosed within second hub extension 320 by welding cover plates 326 and 328 (see FIG. 6) over these ducts.

Figure 7:
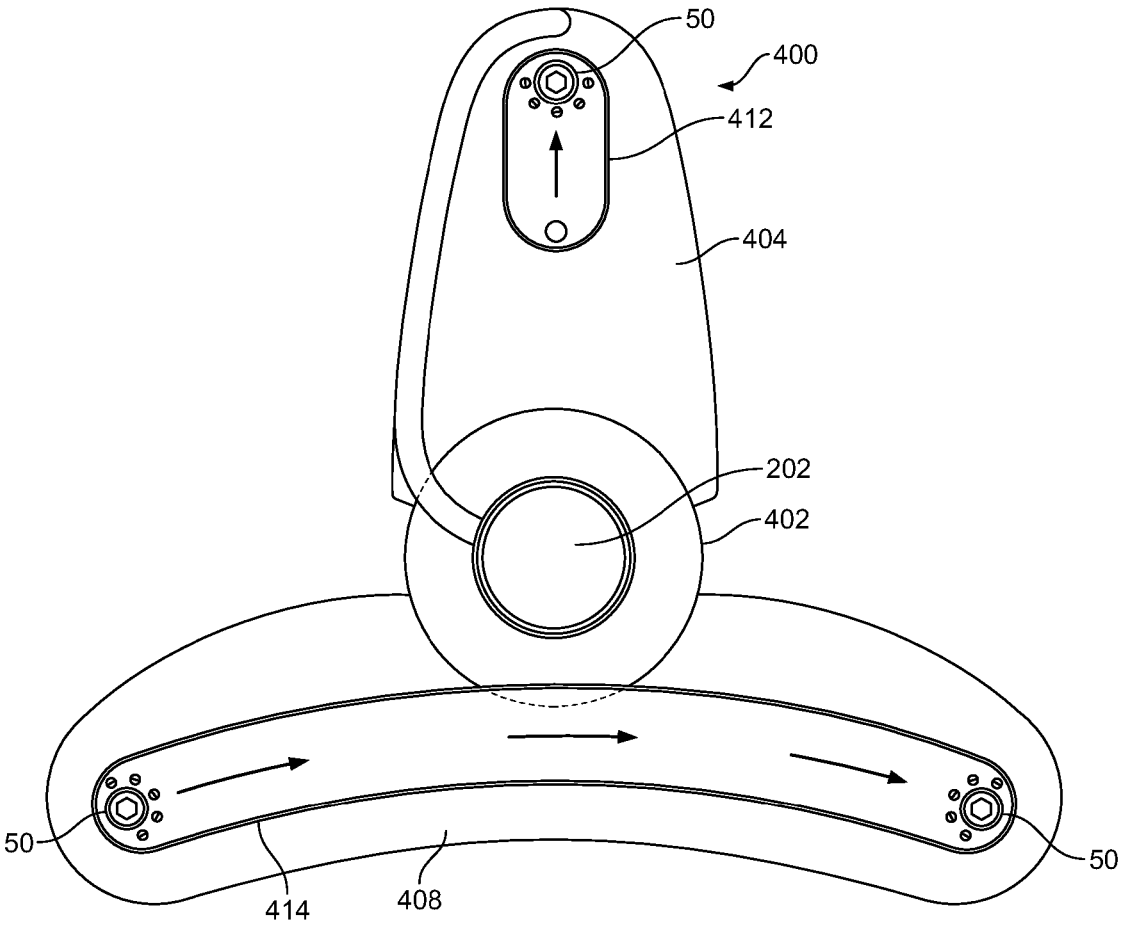
FIG. 7 is an end view of the left-hand side of agitator assembly of FIG. 1.

As best shown in FIGS. 4 and 7, left hub assembly 400 includes left hub 402, to which third hub extension 404 and fourth hub extension 408 are attached. In this embodiment, no fluid passages, ducts, or conduits are formed in either hub 402 or the end of agitator shaft 202 upon which hub 402 is mounted. Third hub extension 404 includes transfer duct 406 (a "bottom to top" transfer duct) that transfers coolant from supply agitator bar 502 to return agitator bar 508. Fourth hub extension 408 includes transfer duct 410 (a "side to side" transfer duct) that transfers coolant from supply agitator bar 600 to return agitator bar 700. Ducts 406 and 410 are typically machined into the metal of third hub extension 404 and fourth hub extension 408 and then enclosed within these hub extension by welding cover plates 412 and 414 (see FIG. 7) over the ducts.

As best shown in FIGS. 4-5, double agitator bar assembly 500 includes two agitator bars having different external and internal diameters that connect first hub extension 312 to third hub extension 404. Supply agitator bar 502 is the smaller of the two agitator bars and includes conduit 504, which is formed lengthwise through agitator bar 502 for supplying coolant to return agitator bar 508. In this embodiment, baffle 506 is positioned within conduit 504 to induce turbulence in coolant flowing through agitator bar 502 and to provide increased structural support for preventing possible collapse of the exterior of the agitator bar during the mixing process. Return agitator bar 508 includes conduit 510 which is formed lengthwise through agitator bar 508 for returning coolant from third hub extension 404 to first hub extension 312. Baffle 512 is positioned within conduit 510 to induce turbulence in coolant flowing through agitator bar 508 and to provide increased structural support for preventing possible collapse of the exterior of the agitator bar during the mixing process. Supply agitator bar 600 includes conduit 602, which is formed lengthwise through agitator bar 600 for supplying coolant from second hub extension 320 to fourth hub extension 408. Return agitator bar 700 includes conduit 702, which is formed lengthwise through agitator bar 700 for returning coolant from fourth hub extension 408 to second hub extension 320. Agitator bars 600 and 700 further include internal baffles 604 and 704 for inducing coolant turbulence and for providing structural support during the mixing process. Agitator bar 600, conduit 602 and baffle 604 may be the same structure as bar 700, conduit 702 and baffle 704, as detailed in FIG. 4.

As shown in FIGS. 4-7, the present invention also includes a plurality of mechanical fasteners 50, which include bolts that are used to squeeze or compress the hub extensions together placing the agitator bars and, therefore, the weld joints under a predetermined amount of compression. Based on any temperature difference the agitator assembly may experience due to repeated thermal expansion and contraction, the agitator bars are unlikely to expand to the point where the weld joint experiences a tensile force. This construction reduces the likelihood of stress cracks developing in the welds where the agitator bars are welded to the hub extensions and substantially increases the durability and longevity of agitator assembly 10.

Advantageously, the present invention may be more easily manufactured than known refrigerated agitators and is therefore less expensive to produce. For example, the parallel flow of coolant allows for reduced machining by utilizing the agitator bars as return channels. This invention also includes a limited number of coolant fluid couplings or joints inside the mixing bowl or product zone. The exemplary embodiment shown in the Figures includes only two fluid passages within mixing bowl and only four sealing joints. The present invention provides an increase in the convective cooling characteristics of a refrigerated agitator assembly through the use of turbulence enhancement in the internal coolant flow of the agitator bars.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. An agitator assembly for use with mixers, comprising:

(a) an agitator shaft, wherein the agitator shaft further includes both a fluid supply passage and a fluid return passage for liquid coolant;

(b) a first hub assembly mounted on one end of the agitator shaft, wherein the first hub assembly further includes:

(i) a first hub having a set of fluid supply and return passages formed therein, wherein the fluid supply and return passages in the first hub are in fluid communication with the fluid supply and return passages in the agitator shaft; and (ii) a first hub extension attached to the hub, wherein the first hub extension includes fluid supply and return passages that are in fluid communication with the fluid supply and return passages formed in the first hub; and (c) a second hub assembly mounted on the opposite end of the agitator shaft, wherein the second hub assembly further includes:

(i) a second hub; and (ii) a second hub extension attached to the second hub, wherein the second hub extension further includes a fluid inlet and a fluid outlet and a transfer duct connecting the fluid inlet to the fluid outlet; and (d) at least one dual agitator bar assembly, wherein the dual agitator bar assembly further includes:

(i) a first agitator bar, wherein the first agitator bar further includes a conduit for transferring coolant between the fluid supply passage of the first hub extension and fluid inlet of the second hub extension; and (ii) a second agitator bar, wherein the second agitator bar further includes a conduit for transferring coolant between the fluid outlet of the second hub extension and the fluid return passage of the first hub extension;

(iii) wherein the first agitator bar has a first internal diameter and a first external diameter and the second agitator bar has a second internal diameter and a second external diameter, and wherein the first internal diameter is different from the second internal diameter, and wherein the first external diameter is different from the second external diameter.

2. The agitator assembly of claim 1, further comprising a plurality of mechanical connectors for attaching the agitator bars to the hub extensions.

3. The agitator assembly of claim 1, further comprising a rotary union assembly in fluid communication with the agitator shaft, wherein the rotary union assembly includes a stationary component and a rotating component and wherein the rotary union assembly further includes a fluid inlet and a fluid outlet.

4. The agitator assembly of claim 1, further comprising a series of turbulence inducing baffles mounted within the conduits of the agitator bars.

5. The agitator assembly of claim 1, further comprising seal inserts and o-rings mounted between fluid supply and return passages in the hub of the first hub assembly and the fluid supply and return passages of the first hub extension.

6. The agitator assembly of claim 1, wherein the agitator assembly is adapted to be used with large-scale industrial dough mixers.

7. The agitator assembly of claim 1, wherein the liquid coolant includes glycol.

8. An agitator assembly for use with mixers, comprising:

(a) an agitator shaft, wherein the agitator shaft further includes both a fluid supply passage and a fluid return passage for liquid coolant;

(b) a first hub assembly mounted on one end of the agitator shaft, wherein the first hub assembly further includes:

(i) a first hub having a first set of fluid supply and return passages formed therein and a second set of fluid supply and return passages formed therein, wherein both sets of fluid supply and return passages in the first hub are in fluid communication with the fluid supply and return passages in the agitator shaft;

(ii) a first hub extension attached to the first hub, wherein the first hub extension includes fluid supply and return passages that are in fluid communication with the first set of fluid supply and return passages formed in the first hub; and (iii) a second hub extension attached to the first hub, wherein the second hub extension includes fluid supply and return passages that are in fluid communication with the second set of fluid supply and return passages formed in the first hub; and (c) a second hub assembly mounted on the opposite end of the agitator shaft, wherein the second hub assembly further includes:

(i) a second hub;

(ii) a third hub extension attached to the second hub, wherein the third hub extension further includes a fluid inlet and a fluid outlet and a first transfer duct connecting the fluid inlet to the fluid outlet; and (iii) a fourth hub extension attached to the second hub, wherein the fourth hub extension further includes a fluid inlet and a fluid outlet and a second transfer duct connecting the fluid inlet to the fluid outlet; and (d) a dual agitator bar assembly, wherein the dual agitator bar assembly further includes:

(i) a first agitator bar, wherein the first agitator bar includes a conduit for transferring coolant between the fluid supply passage of the first hub extension and fluid inlet of the third hub extension; and (ii) a second agitator bar, wherein the second agitator bar includes a conduit for transferring coolant between the fluid outlet of the third hub extension and the fluid return passage of the first hub extension; and (e) a third agitator bar, wherein the third agitator bar further includes a conduit for transferring coolant between the fluid supply passage of the second hub extension and the fluid inlet of the fourth hub extension; and (f) a fourth agitator bar, wherein the fourth agitator bar further includes a conduit for transferring coolant between the fluid outlet of the fourth hub extension and fluid return passage of the second hub extension.

9. The agitator assembly of claim 8, further comprising a plurality of mechanical connectors for attaching the agitator bars to the hub extensions.

10. The agitator assembly of claim 8, further comprising a rotary union assembly in fluid communication with the agitator shaft, wherein the rotary union assembly includes a stationary component and a rotating component and wherein the rotary union assembly further includes a fluid inlet and a fluid outlet.

11. The agitator assembly of claim 8, further comprising a series of turbulence inducing baffles mounted within the conduits of the agitator bars.

12. The agitator assembly of claim 8, further comprising seal inserts and an o-rings mounted between fluid supply and return passages in the hub of the first hub assembly and the fluid supply and return passages of the first and second hub extensions.

13. The agitator assembly of claim 8, wherein the agitator assembly is adapted to be used with large-scale industrial dough mixers.

14. The agitator assembly of claim 8, wherein the liquid coolant includes glycol.

15. An agitator assembly for use with mixers, comprising:

(a) an agitator shaft, wherein the agitator shaft further includes both a fluid supply passage and a fluid return passage for liquid coolant;

(b) a first hub assembly mounted on one end of the agitator shaft, wherein the first hub assembly further includes:

(i) a first hub having a first set of fluid supply and return passages formed therein and a second set of fluid supply and return passages formed therein, wherein both sets of fluid supply and return passages in the first hub are in fluid communication with the fluid supply and return passages in the agitator shaft;

(ii) a first hub extension attached to the first hub, wherein the first hub extension includes fluid supply and return passages that are in fluid communication with the first set of fluid supply and return passages formed in the first hub; and (iii) a second hub extension attached to the first hub, wherein the second hub extension includes fluid supply and return passages that are in fluid communication with the second set of fluid supply and return passages formed in the first hub; and (c) a second hub assembly mounted on the opposite end of the agitator shaft, wherein the second hub assembly further includes:

(i) a second hub;

(ii) a third hub extension attached to the second hub, wherein the third hub extension further includes a fluid inlet and a fluid outlet and a first transfer duct connecting the fluid inlet to the fluid outlet; and (iii) a fourth hub extension attached to the second hub, wherein the fourth hub extension further includes a fluid inlet and a fluid outlet and a second transfer duct connecting the fluid inlet to the fluid outlet; and (d) a dual agitator bar assembly, wherein the dual agitator bar assembly further includes:

(i) a first agitator bar, wherein the first agitator bar includes a conduit for transferring coolant between the fluid supply passage of the first hub extension and fluid inlet of the third hub extension; and (ii) a second agitator bar, wherein the second agitator bar includes a conduit for transferring coolant between the fluid outlet of the third hub extension and the fluid return passage of the first hub extension; and (e) a third agitator bar, wherein the third agitator bar further includes a conduit for transferring coolant between the fluid supply passage of the second hub extension and the fluid inlet of the fourth hub extension;

(f) a fourth agitator bar, wherein the fourth agitator bar further includes a conduit for transferring coolant between the fluid outlet of the fourth hub extension and fluid return passage of the second hub extension; and (g) wherein the longest dimension of the first agitator bar and the longest dimension of the second agitator bar define a first plane, and the longest dimension of the third agitator bar and the longest dimension of the fourth agitator bar define a second plane, and wherein the first plane is perpendicular to the second plane.

16. The agitator assembly of claim 8, further comprising a plurality of mechanical connectors for attaching the agitator bars to the hub extensions.

17. The agitator assembly of claim 8, further comprising a rotary union assembly in fluid communication with the agitator shaft, wherein the rotary union assembly includes a stationary component and a rotating component and wherein the rotary union assembly further includes a fluid inlet and a fluid outlet.

18. The agitator assembly of claim 8, further comprising a series of turbulence inducing baffles mounted within the conduits of the agitator bars.

19. The agitator assembly of claim 8, further comprising seal inserts and an o-rings mounted between fluid supply and return passages in the hub of the first hub assembly and the fluid supply and return passages of the first and second hub extensions.

20. The agitator assembly of claim 8, wherein the agitator assembly is adapted to be used with large-scale industrial dough mixers.

* * * * *